United States Patent [19]

Isohata et al.

[11] Patent Number: 4,797,116

[45] Date of Patent: Jan. 10, 1989

[54] ELECTRICAL CONNECTOR HAVING A MOVABLE CONTACT GUIDE AND LANCE-MAINTAINING MEMBER

[75] Inventors: Shigeru Isohata, Machida; Masao Tsukakoshi, Kawasaki, both of Japan

[73] Assignee: AMP Incorporated, Harrisburg, Pa.

[21] Appl. No.: 186,339

[22] Filed: Apr. 26, 1988

Related U.S. Application Data

[63] Continuation-in-part of Ser. No. 145,428, Jan. 19, 1988.

[30] Foreign Application Priority Data

Jan. 26, 1987 [JP] Japan ..... 62-009823
May 14, 1987 [JP] Japan ..... 62-117918

[51] Int. Cl.[4] ..... H01R 13/424

[52] U.S. Cl. ..... 439/141; 439/274; 439/595

[58] Field of Search ..... 439/140, 141, 274, 595, 439/597–601, 603

[56] References Cited

U.S. PATENT DOCUMENTS 3,747,047 7/1973 Carter et al. ..... 439/141
4,443,048 4/1984 Moist ..... 439/599
4,544,220 10/1985 Aiello et al. ..... 439/494
4,557,542 12/1985 Coller et al. ..... 439/595
4,565,416 1/1986 Rudy et al. ..... 439/592
4,571,017 2/1986 Fujita ..... 439/603
4,655,525 4/1987 Hunt, III et al. ..... 439/599

*Primary Examiner*—Neil Abrams
*Attorney, Agent, or Firm*—William B. Noll; Robert W. Pitts

[57] ABSTRACT

An electrical connector (10) for electrical connection to a complementary electrical connector (20) comprises a housing (10*a*) having electrical contacts (13) secured in passageways (11) by housing lances (14); a movable contact guide member (40) is positioned in the housing (10*a*) and includes a guide plate (41) having holes (43) through which ends of contact sections (132) of contacts (13) extend when the contact guide member is an outer position so that holes (43) serve to align and guide the contact sections (132) for electrical engagement with complementary contact sections (231) of electrical contacts (23) secured in housing (20*a*) when contact guide member (40) moves to an inner position during the engagement between connectors (10, 20); and the movable contact guide member has an inner section (42) that extends along and maintains the housing lances (14) in latching engagement with the contacts (13).

7 Claims, 6 Drawing Sheets

ELECTRICAL CONNECTOR HAVING A MOVABLE CONTACT GUIDE AND LANCE-MAINTAINING MEMBER

CROSS REFERENCE TO RELATED APPLICATION

This application is a continuation-in-part of application Ser. No. 145,428 filed Jan. 19, 1988.

FIELD OF THE INVENTION

This invention relates to an electrical connector; more specifically, it relates to an electrical connector having a movable contact guide and lance-maintaining member.

BACKGROUND OF THE INVENTION

Normally, because a male electrical contact is simply housed in a passageway inside a plug housing of an electrical plug connector, there is some free movement, however small, caused by play between the male contact and the passageway. This can lead to the problem that when the plug housing and a receptacle housing of an electrical receptacle connector are connected together, if there is movement up and down or left and right or both by the male contacts, the ends of the male contact sections will be misaligned with respective female contact sections of female electrical contacts housed in the receptacle housing thereby causing possible damage to the contact sections or housings or both as well as no or improper connection between the plug and receptacle connectors. In order to prevent this, a male contact guide member is provided within the plug housing which can move inside the plug housing in the mating direction while guiding the male contact sections of the male contacts for aligned engagement with the respective female contact sections of the receptacle contacts in the receptacle housing during mating engagement between the plug and receptacle connectors.

This guide member must be in an outer position where it can align the ends of the contact sections of the male contacts, and, when the two housings are mated together, it must be moved to an inner position where it will not impede the electrical engagement of the male and female contacts as disclosed in Japanese U. M. Publication No. 56-37344. The connector of this Publication uses a spring to automatically move the guide member to the outer position at the ends of the contact sections when the connectors are disconnected. However, in such a connector the need for a spring is a deficiency in that it increases the number of parts and assembly time.

SUMMARY OF THE INVENTION

An object of this invention is to provide an electrical connector which addresses the aforementioned problems without increasing the number of parts or assembly time.

The present invention is an electrical connector which comprises a dielectric housing having a male electrical contact matable with a complementary electrical connector including an insulating housing having a female electrical contact. The electrical connector includes a movable contact guide member which aligns a male contact section in the dielectric housing with a female contact section of the female contact in the insulating housing, and it can move freely within the dielectric housing causing the guide member to continually align the male contact section as it moves therealong with the female contact section. A stop of the dielectric housing stops the guide member at an outer position inside the dielectric housing, and latching members of the guide member latchably engaged with the complementary insulating housing are disengaged therefrom when the guide member is stopped by the stop at the outer position.

The guide member also maintains the housing lance in a latched position with the electrical contact thereby doubly locking the contact within the housing.

BRIEF DESCRIPTION OF THE DRAWINGS

The invention, together with objects and advantages thereof, is best understood by way of example with reference to the following detailed description in conjunction with the accompanying drawings.

FIGS. 3 and 4 are similar to FIG. 1 showing the connectors at the first stage of matable engagement and the complete stage of electrical engagement, respectively.

FIG. 8 is an exploded perspective view of the elements of another embodiment.

DETAILED DESCRIPTION OF THE INVENTION

Figure 1:
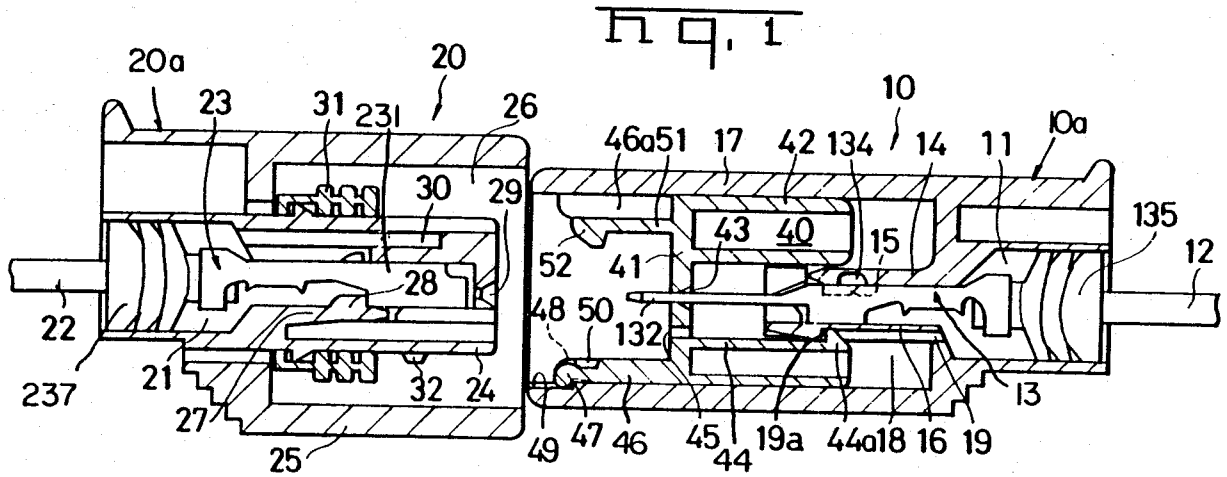
FIG. 1 is an exploded cross-section of plug and receptacle connectors of an electrical connector assembly showing the movable contact guide and lance-maintaining member in an outer position in the plug connector.
Figure 2A:
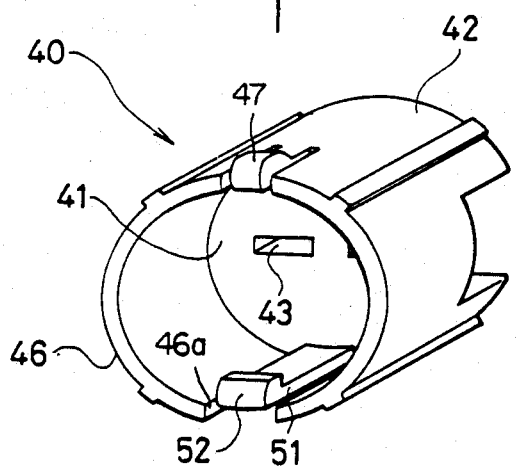
FIG. 2A is a front perspective view of the movable contact guide and lance-maintaining member.
Figure 2B:
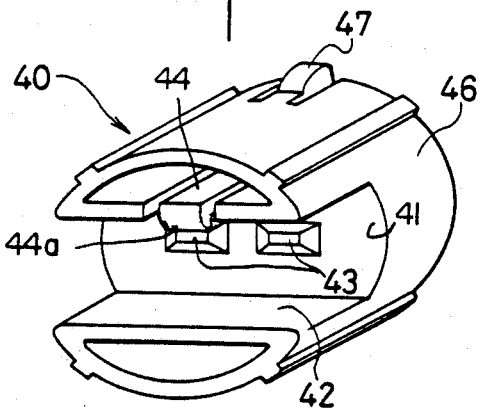
FIGS. 2B and 2C are rear perspective views of the movable contact guide and lance-maintaining member.
Figure 2C:
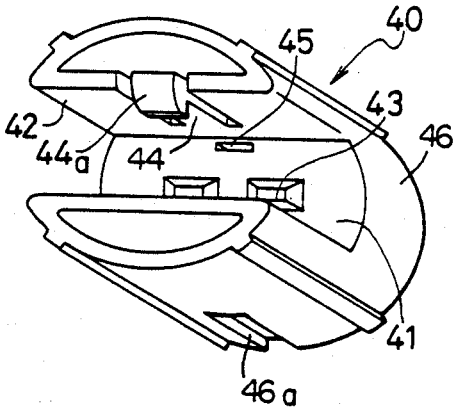

The electrical connector assembly 20*a*, as shown in FIGS. 1–4, includes a plug connector 10 and a receptacle connector 20. Plug connector 10 includes a one-piece molded dielectric housing 10*a* and receptacle connector 20 includes a one-piece molded housing 20*a*, both housings being of a suitable insulating plastic material. Two passageways 11 extend through housing 10*a*, and each passageway 11 receives and secures therein a male electrical contact 13 which is electrically connected to an insulated electrical conductor 12. Two passageways 21 extend through housing 20*a*, and each passageway 21 receives and secures therein a female electrical contact 23 electrically connected to insulated electrical conductor 22.

Figure 5A:
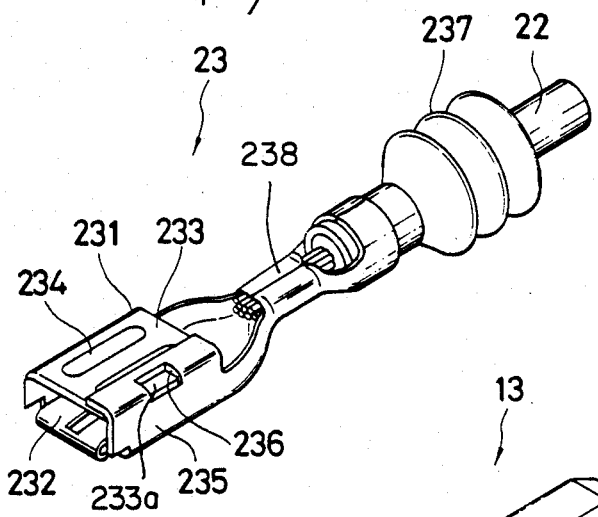
FIGS. 5A and 5B are perspective views of the receptacle contact and the male contact, respectively, that are used in the receptacle connector and plug connector.
Figure 5B:
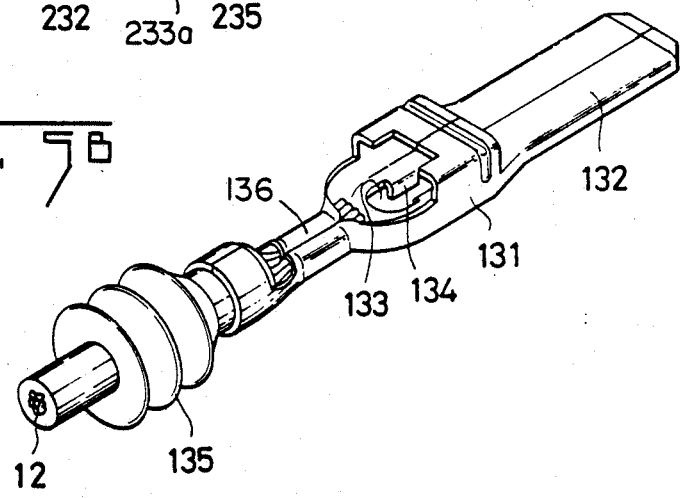

As shown in FIG. 5B, male electrical contact 13 is stamped and formed from a suitable metal sheet and comprises a main section 131 which has a box shape, and a double thickness male contact section 132 which extends from the main section 131. A hole 133, which receives the projection 15 on housing lance 14 of housing 10*a* to secure and prevent backward movement of the male contact 13 from passageway 11 inside housing 10*a*, is located in the main section 131. Opposed projections 134 are provided at the edge of hole 133 in order to prevent upside-down insertion of contact 13 into passageway 11.

As shown in FIG. 5A, female electrical contact 23 is stamped and formed from a suitable metal sheet and has a box-shaped female contact section 231, and the male contact section 132 of the male contact 13 is pressed by the spring leaf 232 which is bent back from the front edge of contact section 231 against the two depressed sections 234 in the upper wall 233 of the contact section when contact section 132 is inserted into contact section 231 so as to make electrical engagement therebetween. The edge of upper wall 233 extends to and engages side wall 235, and a projection 233*a* is located midway along the edge. A hole 236 is located in side wall 235 in the position where it receives projection 233*a* of upper wall 233 therein and the upper part of side wall 235 is bent over at hole 236 so that it engages upper wall 233 and retains the edge of upper wall 233 thereagainst. By means of this construction of the contact section 231 of female contact 23, opening of upper wall 233 and a loss of contact force on contact section 132 is prevented when male contact section 132 is inserted into the contact section 231 of female contact 23. Conductors 12, 22 connected respectively to the two contacts 13, 23 are surrounded by rubber seals 135 and 237, which serve the purpose of sealing the passageways 11, 21 of housings 10*a*, 20*a* and preventing the intrusion of water when the contacts are inserted into the passageways.

Passageway 21 in housing 20*a* is delimited by the ring-shaped inner wall 24 in housing 20*a*. Outer wall 25 surrounds and is spaced from inner wall 24 so that a cavity 26 is located between outer wall 25 and inner wall 24. Flexible lance 27 extends from the wall of passageway 21 in the direction of insertion. Lance 27 has a projection 28 which engages the upper wall 233 of the contact section 231 of contact 23. The front edge of passageway 21 communicates with the outside through a hole 29 which is large enough for the contact section 132 of male contact 13 to pass through so that it electrically engages the contact section 231 of female contact 23. Inner wall 24 has a channel 30 on the side facing cavity 26, and the projection 52 of movable contact guide and lance-retaining member 40, described more fully below, is inserted into channel 30. Inner wall at its inner end is surrounded by a gasket 31; this prevents the intrusion of water into passageways 11, 21 when connector 10 is mated together with connector 20.

Housing 10*a* is also provided with a flexible housing lance 14 which extends from the wall of passageway 11 in the direction of insertion of contact 13. Lance 14 is inserted between the projections 134 on contact 13 and has a projection 15 which is received by hole 133 on contact 13 with which it engages. This prevents the pulling out of contact 13 from passageway 11. Wall 16 of housing 10*a* extends parallel to lance 14 and serves as a guide when contact 13 is inserted in passageway 11, as well as a guide for member 40. Furthermore, plug housing 10*a* includes shroud 17 that surrounds wall 16 and lance 14 thereby forming cavity 18 therebetween, and it is received by cavity 26 of housing 20*a* and simultaneously engages sealing gasktet 31 and the inside surface of outside wall 25 of housing 20*a* when connectors 10 and 20 are mated together.

Movable contact guide and lance-retaining member 40 is disposed inside shroud 17 and is movable therealong. Member 40 includes a guide plate 41 and inner guide section 42 which is movable along cavity 18. Guide plate 41 includes holes 43 through which the contact sections 132 of male contacts 13 extend. Inner guide section 42 is divided into two sectons which move along cavity 18 between shroud 17 and wall 16 thereby maintaining lance 14 in its contact-securing position.

Wall 16 is provided with a channel 19 which receives projection 44*a* of flexible arm 44 on guide 42. Projection 44*a* engages shoulder 19*a* at the inner end of channel 19 when member 40 is at an outer position thereby stopping member 40 and preventing member 40 from leaving housing 10*a*. A thin hole 45 adjacent an inside surface of one section of inner guide section 42 is located in guide plate 41, and by inserting a narrow fixture into hole 45 and moving arm 44 downward as shown in FIG. 1, projection 44*a* is unlatched from shoulder 19*a* thereby enabling member 40 to be removed from housing 10*a*. For this purpose, wall 16 from shoulder 19*a* outward is formed with a taper, and the fixture can be inserted easily between wall 16 and arm 44. Also, because the inside surface of one section of inner guide section 42 extends along lance 14, guide section 42 serves to extend along lance 14 and prevent it from moving upward thereby maintaining lance 14 in position with projection 15 in hole 13 of male contact 13. Thus, this results in a double lock arrangement of contact 13 in housing 10*a*.

Outer guide section 46 of member 40 is located on the opposite side of guide plate 41, and it has an integral flexible latching arm 47 which engages the edge of recess 49 at the outer end along the inside surface of shroud 17 and maintains member 40 in an outer position. In its outer position, guide 41 receives the end of male contact section 132 of male contact 13 in the hole 43 and by this aligns and guides contact section 132 with the contact section 231 of contact 23 when connectors 10, 20 are connected.

When latching arm 47 rides up on the edge of recess 49 during movement of member 40 along housing 10*a*, it moves to the position shown by dotted lines 48 in FIG. 1 and forms a recess 50. When the housings 10*a*, 20*a* are mated, the projection 32 on the inside wall 24 of housing 20*a* is disposed in recess 50. In this manner latching arm 47 serves together with projection 32 as a latching device between member 40 and housing 20*a*. A space 46*a* is located in outer guide section 46, and a flexible latching arm 51 projects from guide plate 41 in alignment with but spaced inwardly from such space. A projection 52 is located at the free end of latching arm 51 and is inserted into the channel 30 located in the inside wall 24 of housing 20*a* when the housings are connected. Thus, latching arm 51 with projection 52 disposed in channel 30 also serves as another latching device between member 40 and housing 20*a*.

To assemble connector 10, female contacts 13 are first inserted into passageways 11 of housing 10*a* with the projections 15 on housing lances 14 being disposed in holes 133 in male contacts 13; passageways 11 being sealed with rubber seals 135. If projections 134 engage the rear edge of wall 16, it will not be possible to seat the contact in passageway 11. Next, movable contact guide and lance-maintaining member 40 is inserted into housing 10*a* so that inner guide section 42 is disposed in cavity 18 overlying lances 14 and projection 44*a* of flexible arm 44 is disposed into channel 19 and against shoulder 19*a*. Latching arm 47 engages the edge of recess 49 thereby causing member 40 be maintained in an outer position such that holes 43 of guide plate 41 through which the ends of contact sections 132 of contacts 13 extend are in an aligned position for engagement with contact sections 231 of contacts 23 when connectors 10, 20 are connected.

To assemble connector 20, female contacts 23 are inserted into passageways 21 and housing lances 28 engage the edges of contact sections 231; passageways 21 being sealed with rubber seals 237. Gasket 31 is placed in cavity 26 and connector 20 is now completed.

Figure 4:
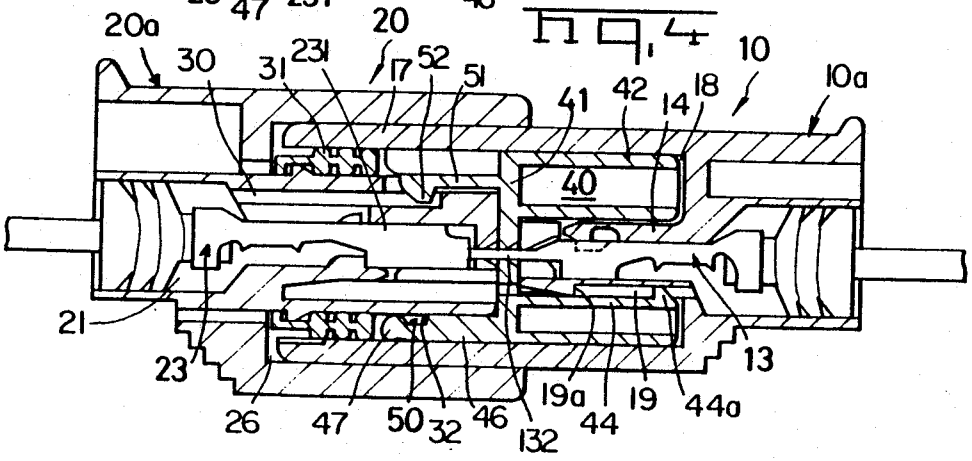

FIGS. 3 and 4 show the order in which connectors 10, 20 are connected together. As shown in FIG. 3, when shroud 17 is inserted into cavity 26, the fact that contact section 132 is aligned into the appropriate prescribed position by guide plate 41 causes contact section 132 to be inserted into hole 29 in housing 20*a* without hitting the surrounding walls, so that it can be accurately inserted between the spring leaf 232 of female contact section 231 and wall 234. At this point, the position of latching arm 47 is located in recess 49 of shroud 17 ensures that member 40 will remain in the outer position until the projection 52 on latching arm 51 moves over inside wall 24 and into channel 30 of housing 20*a* thus making insertion into the hole 29 by contact section 132 easier.

When the front end of wall 24 of connector 20 engages guide plate 41 of member 40 in connector 10 during the initial engagement of connectors 10, 20 as shown in FIG. 3, shroud 17 of connector 10 is partly disposed in cavity 26 of connector 20 in engagement with sealing gasket 31, projection 52 of latching arm 51 is disposed in channel 30, the front end of male contact section 132 extends through hole 29 ready to move into female contact section 231 and projection 32 on wall 24 is positioned in alignment with recess 50 on the inner surface of outer guide section 46 of member 40.

Further movement of connectors 10, 20 relative to one another until they are completely electrically connectetd as shown in FIG. 4, causes inner guide section 42 of member 40 to move to an inner position in cavity 18 of connector 10, projection 44*a* of latch arm 44 to move to an inner position in channel 19 of connector 10, shroud 17 to move to an inner position in cavity 26 in sealing engagement wth sealing gasket 31, latching arm 47 to move out of recess 49 and move along the inside surface of shroud 17 while engaging projection 32 and male contact section 132 to be completely engaged with female contact section 231. Holes 43 of guide plate 41 of member 40 maintain male contact sections 132 in continuous alignment with female contact sections 231 as member 40 moves from its outer position to its inner position in connector 10 during the mating engagement of connectors 10, 20 while also maintaining housing lances 14 of connector 10 in their latched positions with male contacts 13.

Thus, member 40 acts to guide male contat sections 132 so as to be in proper alignment for electrical engagement with female contact sections 231 when it moves from an outer position to an inner position during connection of connectors 10, 20, and member 40 also maintains housing lances 14 in latching engagement with male contacts 13 in connector 10 when member 40 is located therein.

When connectors 10, 20 are disconnected, member 40 is moved from its inner position to its outer position. This is accomplished by projection 52 of latching arm 51 in engagement with an inner end of channel 30 and latching arm 47 engaging projection 32 and projection 44*a* of latching arm 44 moving along channel 19. When projection 44*a* engages shoulder 19*a* stopping member 40 at its outer positin, latching arm 47 moves into recess 49 freeing latching arm 47 from projection 32 thereby disconnecting one of the latching arrangements between member 40 and connector 20. Further movement of connectors 10, 20 to disconnect them causes the inner tapered surface of projection 52 to engage the inner end of channel 30 which cams latching arm 51 upwardly freeing projection 52 from channel 30 thereby disconnecting the other latching arrangement between member 40 and connector 20 so that member 40 remains at its outer position in connector 10, as shown in FIG. 3, during the remaining disconnection between connectors 10, 20 and remains there at, as shown in FIG. 1, because latching arm 47 is disposed in recess 49. Thus, member 40 is automatically moved to and retained at its outer position in connector 10 when connectors 10, 20 are disconnected.

Figure 7:
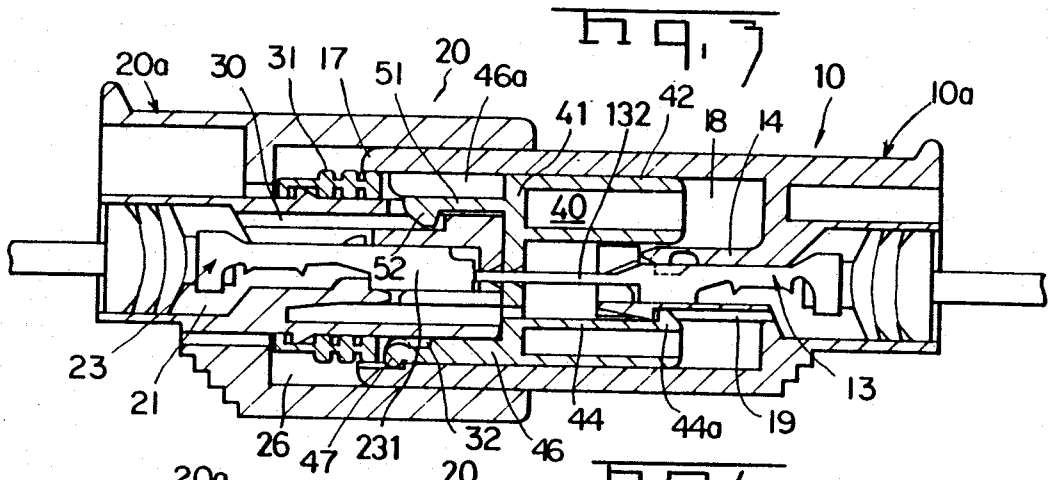
FIGS. 6 and 7 are cross sections of an alternative embodiment similar to FIGS. 4 and 1, respectively.
Figure 6:
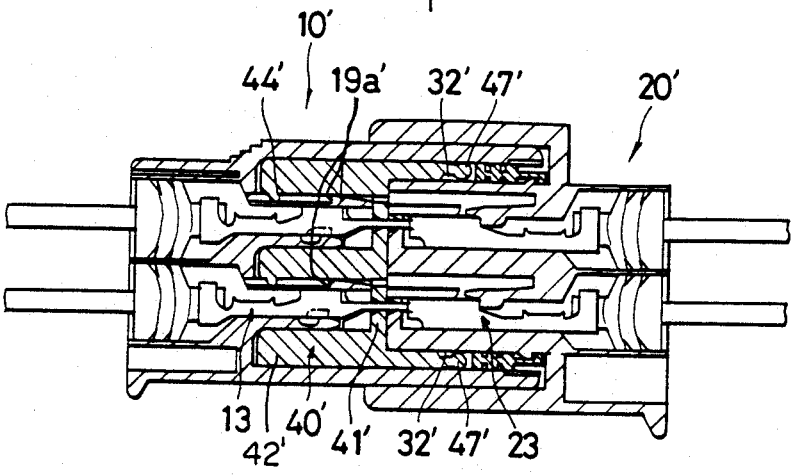
Figure 7:
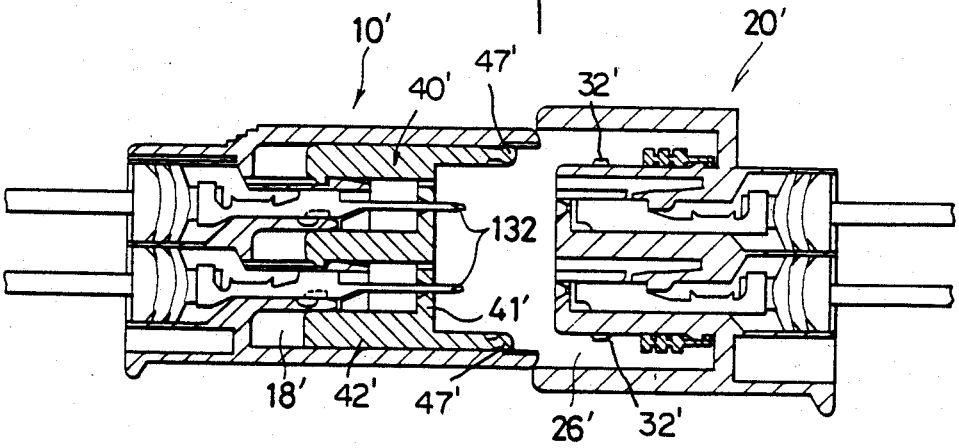
Figure 6:
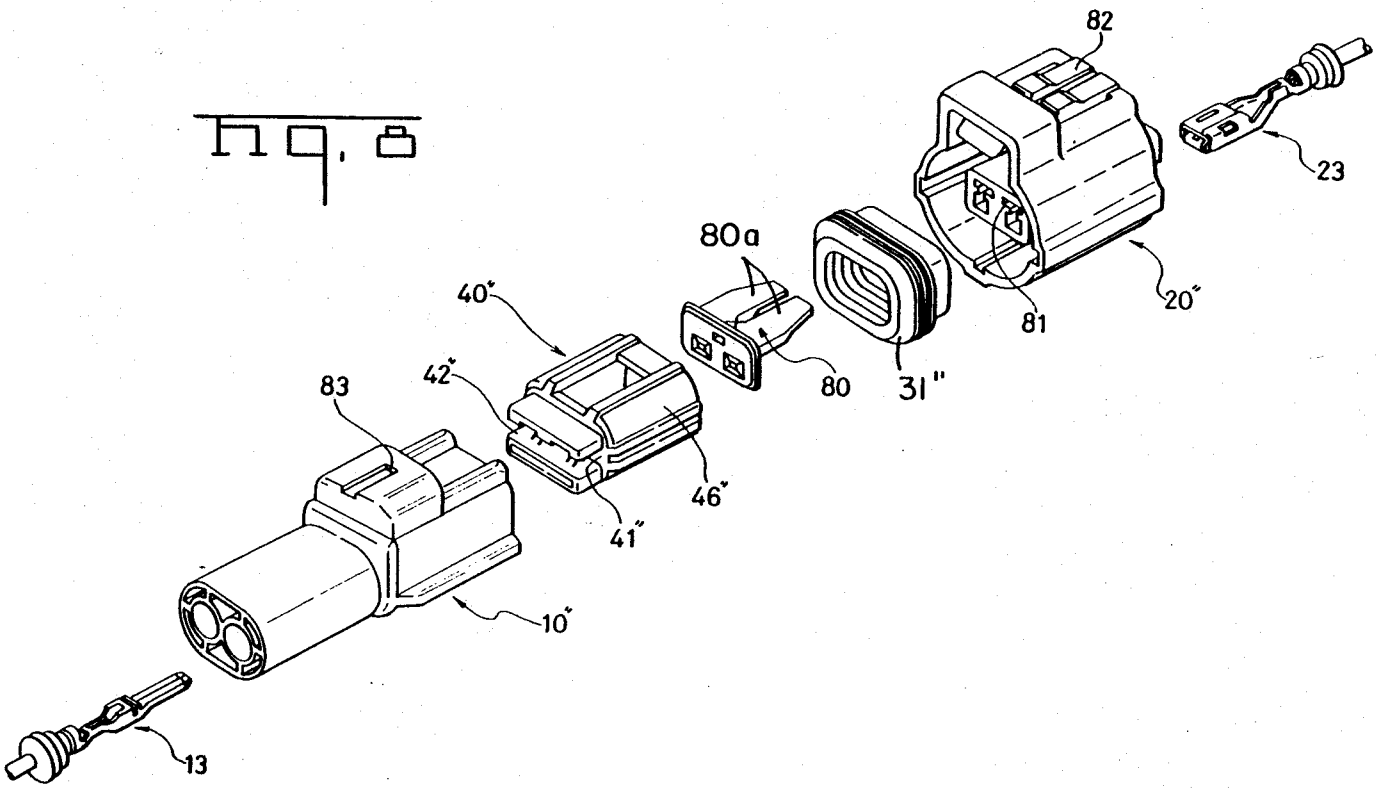

FIGS. 6 and 7 show an embodiment of the connector assembly in which the housings each have two electrical contacts 13, 23, member 40 has three sections of inner guide section 42'0 and the latching device does not use the construction of the latching arm 51 with projection 52 in channel 30, but rather uses the engagement between latching arms 4' and projections 32', so that member 40' is returned to its original outer position when the connectors 10°, 20' are disconnected. Otherwise, the connector structure of connectors 10°, 20' is the same as that of connectors 20, 20.

FIG. 8 shows another embodiment of the connector assembly wherein a member 80 includes plate members 80*a* that are disposed in channels 81 between the housing lances (lance 27 in FIG. 1) in the housing of connector 20" and the inside wall (wall 24 in FIG. 1). this functions to maintain the housing lances in position and prevent them from leaving the female contact sections. A latch 82 is located on the upper surface of the housing of connector 20", and a notch 83 which engages latch 82 is located on the upper surface of the housing of connector 10".

As explained above, because no springs or other component parts are required to return the movable contact guide and lance-maintaining member to its original position, it is possible to reduce the number of parts and assembly time required.

By providing a guide plate, the contact section of the male contact can be held in a suitable position, and it is possible to correct slight deformities of the contact section. When the plug connector is assembled, it is also possible to see that the male contact is fully seated in the passageway by noting the length of the male contact section which protrudes from the guide plate. The contact section is also protected, since it is not completely exposed due to the guide plate.

By providing the movable contact guide and lance-retaining member, it is additionally possible to determine when contact seating is incomplete from the fact that when the male contact is not fully seated in the passageway, the member engages the raised housing lance. Also, by extending along the housing lance, the member prevents the lance from moving up and is therefore maintained in a latched position in engagement with the contact.

We claim:

1. An electrical connector for electrical engagement with a complementary electrical connector, comprising:

a dielectric housing having passageway means extending therethrough in which electrical contact means disposed;

housing lance means engaging the contact means maintaining said contact means in said passageway means;

movable contact guide means disposed in said housing and having guide plate means provided with hole means through which a front end of contact section means of said contact means extend in order to align and guide the contact section means for electrical engagement with complementary contact section means in the complementary electrical connector when the electrical connector electrically connects with the complementary electrical connector as the movable contact guide means moves along said housing from an outer position to an inner position during the connection between the electrical connector and the complementary electrical connector; and means provided by said movable contact guide means maintaining the housing lance means in engagement with the contact means.

2. An electrical connector as claimed in claim 1, wherein means are provided between said housing and said movable contact guide means to maintain the movable contact guide means in the outer position in said housing when the electrical connector is disconnected from the complementary electrical connector.

3. An electrical connector as claimed in claim 2, wherein the means to maintain the movable contact guide means in the outer position comprises latching arm means on said movable contact guide means disposed in a recess in an inside surface of said housing.

4. An electrical connector as claimed in claim 1, wherein means are provided between the movable contact guide means and the complementary electrical connector to move the movable contact guide means from the inner position in the housing when the electrical connector and the complementary electrical connector are connected to the outer position when the electrical connector and the complementary electrical connector are disconnected.

5. An electrical connector as claimed in claim 4, wherein the means to move the movable contact guide means from the inner position to the outer position comprises flexible latch arm means having projection means on said movable contact guide means for disposition in channel means in the complementary electrical connector.

6. An electrical connector as claimed in claim 1, wherein the means to move the movable contact guide means from the inner position to the outer position comprises latch arm means on said movable contact guide means engageable with projection means on the complementary electrical connector.

7. An electrical connector as claimed in claim 1, wherein stop means are provided by the housing and said movable contact guide means to stop said movable contact guide means at said outer position and means provided between said movable contact guide means and said housing to maintain said movable contact guide means at the outer position.

* * * * *

UNITED STATES PATENT AND TRADEMARK OFFICE

CERTIFICATE OF CORRECTION

PATENT NO. : 4,797,116

DATED : Jan. 10, 1989

INVENTOR(S) : Shigeru Isohata, et al.

It is certified that error appears in the above-identified patent and that said Letters Patent is hereby corrected as shown below:

Column 6, line 68, claim 1, after "means" insert --are--.

Signed and Sealed this

Second Day of May, 1989

*Attest:*

*Attesting Officer*

DONALD J. QUIGG

*Commissioner of Patents and Trademarks*